US009797650B2

(12) United States Patent
Sanders et al.

(10) Patent No.: US 9,797,650 B2
(45) Date of Patent: Oct. 24, 2017

(54) THERMALLY INSULATED DOOR ASSEMBLY AND METHOD

(71) Applicant: Illinois Tool Works Inc., Glenview, IL (US)

(72) Inventors: Joseph F. Sanders, Fort Worth, TX (US); Timothy G. Waller, Fort Worth, TX (US); Matthew K. McAleer, Fort Worth, TX (US)

(73) Assignee: Illinois Tool Works Inc., Glenview, IL (US)

( * ) Notice: Subject to any disclaimer, the term of this patent is extended or adjusted under 35 U.S.C. 154(b) by 461 days.

(21) Appl. No.: 14/522,708

(22) Filed: Oct. 24, 2014

(65) Prior Publication Data

US 2015/0198366 A1 Jul. 16, 2015

Related U.S. Application Data

(60) Provisional application No. 61/925,820, filed on Jan. 10, 2014.

(51) Int. Cl.
*F25D 27/00* (2006.01)
*F21V 29/70* (2015.01)
(Continued)

(52) U.S. Cl.
CPC ..... *F25D 27/00* (2013.01); *A47F 3/0434* (2013.01); *E06B 3/66376* (2013.01); *E06B 7/00* (2013.01);
(Continued)

(58) Field of Classification Search
CPC . F21V 29/70; F25D 27/00; E06B 7/00; E06B 3/66376
(Continued)

(56) References Cited

U.S. PATENT DOCUMENTS

| | | | | |
|---|---|---|---|---|
| 4,754,377 | A | 6/1988 | Wenman | |
| 6,354,098 | B1 | 3/2002 | Bardin et al. | |
| 6,550,269 | B2 | 4/2003 | Rudick | |
| 6,726,341 | B2 | 4/2004 | Pashley et al. | |
| 7,586,274 | B2 | 9/2009 | Primiano | |
| 8,013,541 | B2 | 9/2011 | Primiano | |
| 8,683,745 | B2 | 4/2014 | Artwohl et al. | |
| 2007/0177391 | A1 | 8/2007 | Davis et al. | |
| 2009/0021130 | A1 | 1/2009 | Weiss | |
| 2009/0310346 | A1 | 12/2009 | Wachters et al. | |
| 2010/0281910 | A1 | 11/2010 | Riemeijer et al. | |
| 2012/0176784 | A1* | 7/2012 | Peifer | F21K 9/00 362/217.05 |
| 2012/0320564 | A1* | 12/2012 | Davis | A47F 3/001 362/92 |

(Continued)

FOREIGN PATENT DOCUMENTS

| | | | |
|---|---|---|---|
| EP | 1834836 | A | 9/2007 |
| EP | 2016872 | A1 | 1/2009 |

(Continued)

OTHER PUBLICATIONS

ISR and WO for PCT/US2014/062798 dated Feb. 25, 2015 (15 pgs.).

*Primary Examiner* — Anabel Ton
(74) *Attorney, Agent, or Firm* — Christopher R. Carroll; The Small Patent Law Group, LLC.

(57) ABSTRACT

A thermally insulated door assembly includes first and second panes of light transmissive material, a light assembly, and a heat sink. The first pane and the second pane are spaced apart from each other by a separation gap to define an interior chamber. The light assembly is in the interior chamber between the first pane and the second pane, and is configured to generate light within the interior chamber. The heat sink is disposed within the interior chamber and coupled with the light assembly and an inwardly facing surface of the first pane. The heat sink is configured to conduct thermal energy generated by the light assembly onto an inwardly facing surface of the first pane and into the interior chamber such that the inwardly facing surface of the first pane and the interior chamber are heated by the light assembly.

19 Claims, 4 Drawing Sheets

(51) Int. Cl.

| | |
|---|---|
| ***E06B 7/00*** | (2006.01) |
| ***F21V 33/00*** | (2006.01) |
| ***F25D 23/02*** | (2006.01) |
| ***A47F 3/04*** | (2006.01) |
| ***E06B 3/663*** | (2006.01) |
| ***F25D 21/04*** | (2006.01) |
| *A47F 3/00* | (2006.01) |
| *F21Y 115/10* | (2016.01) |

(52) U.S. Cl.
CPC ..... *F21V 29/70* (2015.01); *F21V 33/0044* (2013.01); *F25D 21/04* (2013.01); *F25D 23/028* (2013.01); *A47F 3/001* (2013.01); *F21Y 2115/10* (2016.08); *F25D 2323/02* (2013.01); *F25D 2400/36* (2013.01)

(58) Field of Classification Search
USPC ..... 362/92
See application file for complete search history.

(56) References Cited

U.S. PATENT DOCUMENTS

| | | | | |
|---|---|---|---|---|
| 2013/0285517 | A1 | 10/2013 | Wach et al. | |
| 2016/0095450 | A1* | 4/2016 | Trulaske, Sr. ..... | A47F 11/10 312/116 |

FOREIGN PATENT DOCUMENTS

| | | | |
|---|---|---|---|
| JP | 2007182704 | A | 7/2007 |
| KR | 101161114 | B1 | 6/2012 |
| WO | 2009135243 | A1 | 11/2009 |
| WO | 2012028814 | A1 | 3/2012 |

* cited by examiner

THERMALLY INSULATED DOOR ASSEMBLY AND METHOD

CROSS-REFERENCE TO RELATED APPLICATIONS

This application claims priority to U.S. Provisional Application No. 61/925,820, which was filed on 10 Jan. 2014, and the entire disclosure of which is incorporated herein by reference.

BACKGROUND

Embodiments of the inventive subject matter described herein relate to door assemblies, such as thermally insulated doors used to enclose and provide access to refrigerated housings, such as refrigerators, freezers, cooled commercial displays, and the like.

BRIEF DESCRIPTION

In one example of the inventive subject matter described herein, a thermally insulated door assembly includes an outer first pane of light transmissive material, a second pane of light transmissive material, a light assembly, and a heat sink. The first pane has an outwardly facing surface and an opposite inwardly facing surface. The second pane has an outwardly facing surface and an opposite inwardly facing surface. The outwardly facing surface of the second pane faces the inwardly facing surface of the first pane. The first pane and the second pane are spaced apart from each other by a separation gap to define an interior chamber. The light assembly is disposed within the interior chamber between the first pane and the second pane, and is configured to generate light within the interior chamber. The heat sink is disposed within the interior chamber and coupled with the light assembly and the inwardly facing surface of the first pane. The heat sink is configured to conduct thermal energy generated by the light assembly onto the inwardly facing surface of the first pane and into the interior chamber such that the inwardly facing surface of the first pane and the interior chamber are heated by the light assembly.

In another example of the inventive subject matter described herein, a method for providing a thermally insulated door assembly and/or for heating a thermally insulated door assembly is provided. The method includes positioning a heat sink in an interior chamber of the door assembly between an outer first pane of light transmissive material and a second pane of light transmissive material. The first pane has an outwardly facing surface and an opposite inwardly facing surface. The second pane has an outwardly facing surface and an opposite inwardly facing surface. The outwardly facing surface of the second pane faces the inwardly facing surface of the first pane. The first pane and the second pane are spaced apart from each other by a separation gap to define the interior chamber in which the heat sink is positioned. The method also can include coupling a light assembly with the heat sink in the interior chamber of the door assembly. The light assembly can be coupled with the heat sink to generate light in the interior chamber of the door assembly and to generate thermal energy. The heat sink can be positioned in the interior chamber such that the heat sink is coupled with the inwardly facing surface of the first pane such that the heat sink conducts the thermal energy generated by the light assembly onto the inwardly facing surface of the first pane and into the interior chamber in order to heat the inwardly facing surface of the first pane and the interior chamber.

In another example of the inventive subject matter described herein, a door assembly includes an outer glass pane, an interior glass pane, an inner glass pane, a light assembly, and a heat sink. The outer glass pane has an exterior surface and an opposite interior surface. The interior glass pane has an outwardly facing surface and an opposite inwardly facing surface. The interior glass pane is spaced apart from the outer glass pane by a separation gap to define a first interior chamber. The outwardly facing surface of the interior glass pane faces the interior surface of the outer glass pane. The inner glass pane has an outwardly facing surface and an opposite interior surface. The inner glass pane is spaced apart from the interior glass pane by a separation gap to define a second interior chamber. The outwardly facing surface of the inner glass pane faces the inwardly facing surface of the interior glass pane. The light assembly is disposed in the first interior chamber between the outer glass pane and the interior glass pane. The light assembly is configured to generate light and thermal energy. The heat sink is disposed in the first interior chamber between the outer glass pane and the interior glass pane. The heat sink prevents condensation on the outer glass pane by conducting at least some of the thermal energy generated by the light assembly to the interior surface of the outer glass pane to heat the interior surface of the outer glass pane.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
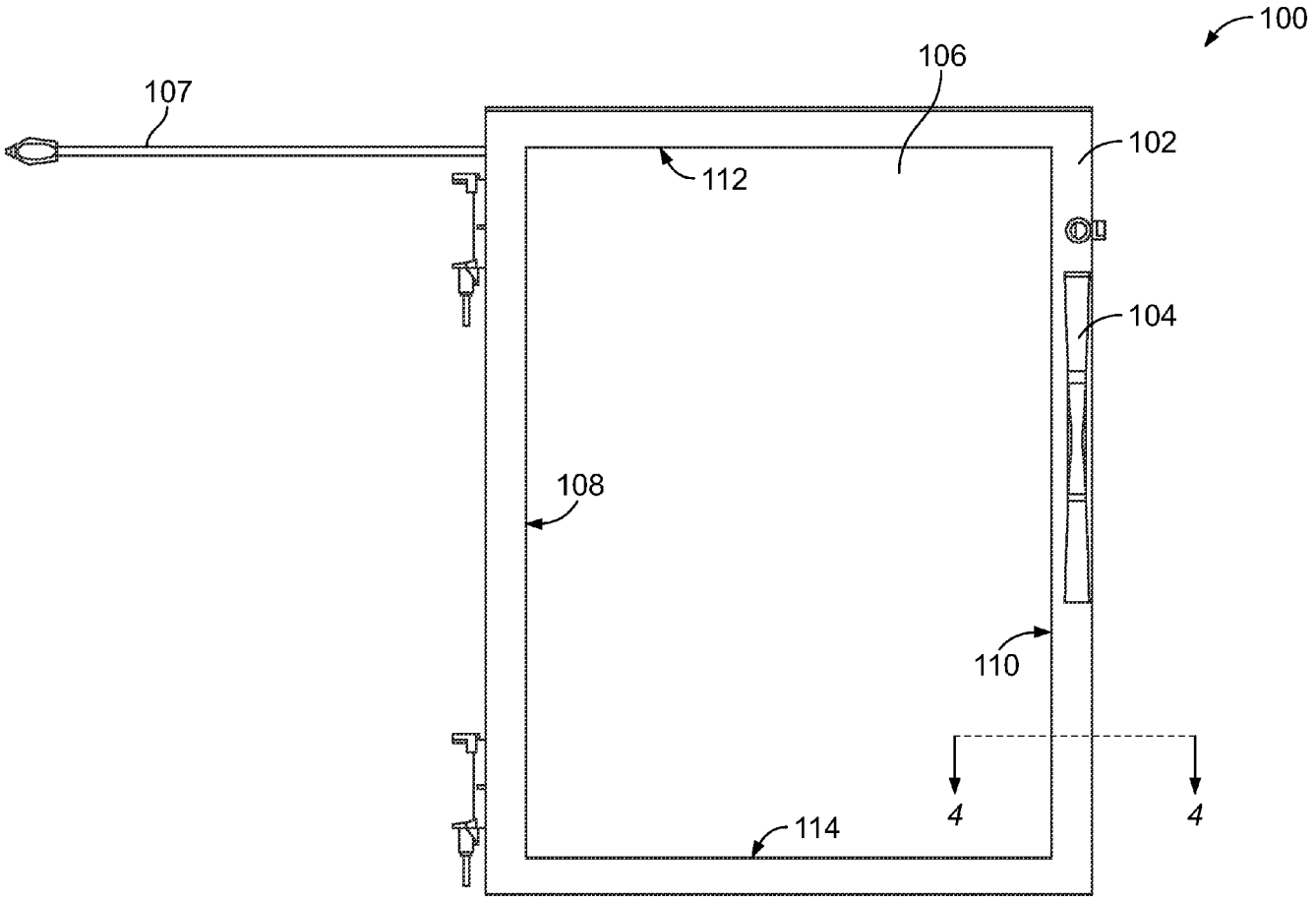
FIG. 1 illustrates a front view of a thermally insulated door assembly in accordance with one example of the inventive subject matter described herein.

FIG. 1 illustrates a front view of a thermally insulated door assembly 100 in accordance with one example of the inventive subject matter described herein. The door assembly 100 includes a door frame 102 that encircles or otherwise extends around a perimeter of one or more light transmissive panes 106, such as glass or polymer sheets that allow light to pass there through. The door frame 102 is coupled with a handle 104 to allow a person to open or close the door assembly 100. A power supply wire or cord 107 supplies electric energy (e.g., current) to one or more light assemblies (described below) in the door assembly 100.

Figure 2:
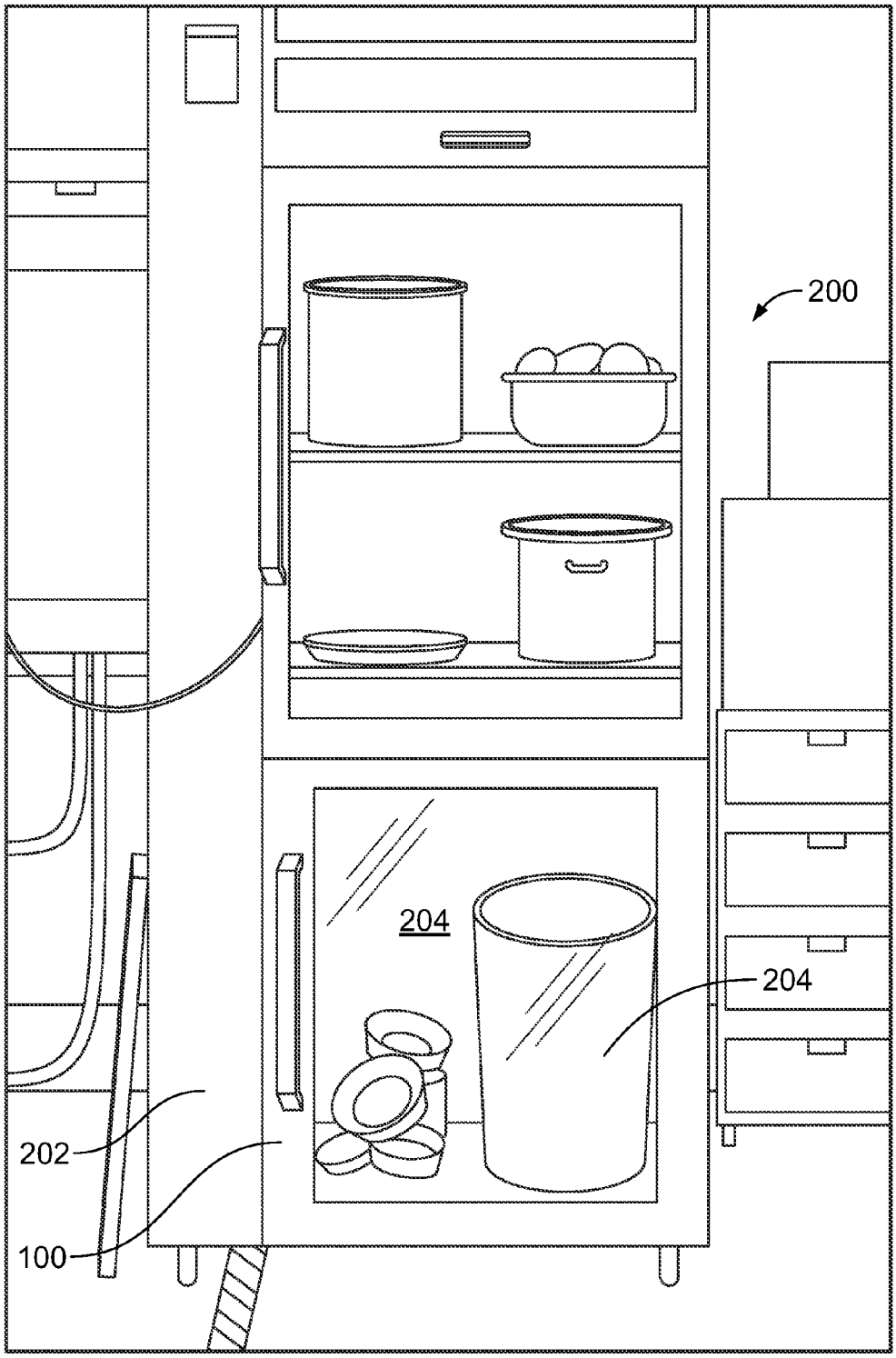
FIG. 2 illustrates a cooling system that includes the door assembly shown in FIG. 1 in accordance with one example of the inventive subject matter described herein.

With continued reference to the door assembly 100 shown in FIG. 1, FIG. 2 illustrates a cooling system 200 that includes the door assembly 100 in accordance with one example of the inventive subject matter described herein. The cooling system 200 includes a refrigerated housing 202 to which the door assembly 100 is coupled. The housing 202 can store one or more products 204 that are cooled or kept frozen by the system 200. For example, the system 200 can represent a refrigerator, freezer, or other cooled container, and the door assembly 100 can be opened or closed to provide access to an interior space 204 of the refrigerator, freezer, or other cooled container. The system 200 can be used for a commercial display of food products, such as in a grocery store, gas station, or the like. The door assembly 100 can prevent or reduce the cold air in the housing 202 from escaping while allowing customers or other viewers outside of the housing 202 to look through the door assembly 100 to see the products in the housing 202.

Figure 3:
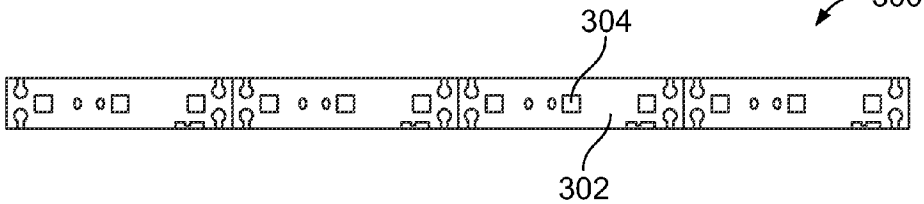
FIG. 3 is a schematic view of one example of a light assembly that can be included in the door assembly shown in FIG. 1.

FIG. 3 is a schematic view of one example of a light assembly 300 that can be included in the door assembly 100 shown in FIG. 1. The door assembly 100 can include one or more of the light assemblies 300 disposed between two or more panes of the door assembly 100. In the illustrated example, the light assembly 300 includes an elongated body 302 having light generating devices 304 coupled thereto. The light generating devices 304 can include any of a variety of devices that generate light, such as light emitting diodes (LEDs) or other lights. One or more light assemblies 300 can be disposed within and oriented along opposite vertical sides 108, 110 (shown in FIG. 1) of the door assembly 100, but additionally or alternatively may be positioned along opposite horizontal sides 112, 114 (shown in FIG. 1) of the door assembly 100.

The light assembly 300 is powered to generate light inside of the door assembly 100. Additionally, the light assembly 300 can generate thermal energy, such as heat that is a byproduct of generating the light. Optionally, the light assembly 300 can represent a heating assembly inside the door assembly 100 that does not generate light, but that generates thermal energy to heat one or more interior surfaces or chambers of the door assembly 100. For example, in addition to or in place of one or more of the light assemblies 300, the door assembly 100 may include resistive elements (e.g., resistors) that convert electric current into heat inside the door assembly 100.

In order to prevent the heat generated from the light assembly 300 from heating the product inside the housing 202 of the cooling system 200 (and thereby require additional energy to be used to maintain the temperature of the product inside the cooling system 202 sufficiently low to prevent spoilage or heating of the product), the door assembly 100 may thermally conduct thermal energy away from the product that is inside the housing 202. The door assembly 100 can thermally transfer the heat generated by the light assembly 300 and onto an interior surface of one or more panes of the door assembly 100 and/or into one or more interior chambers inside the door assembly 100 that are between the panes of the door assembly 100. Transferring the thermal energy in this manner can prevent condensation from building up on the door assembly 100. For example, conducting the heat from the light assembly 300 to these locations can prevent condensation from developing on the exterior surface of the door assembly 100 facing the customer looking through the door assembly 100 into the refrigerated housing).

Additionally or alternatively, the door assembly 100 can direct at least some of the light generated by the light assembly 300 inside the door assembly 100 away from locations that would reflect this light back toward the customer or other viewer looking through the door assembly 100 at the products in the housing 202 of the cooling system 200. For example, the door assembly 100 may prevent light created by the light assembly in the door assembly 100 from being reflected off of one or more surfaces of the panes in the door assembly 100 and back toward the customer or viewer. Preventing the light from reflecting in this way can reduce glare and make it easier for the customer or view to see the products in the refrigerated housing 202 behind the door assembly 100.

Figure 4:
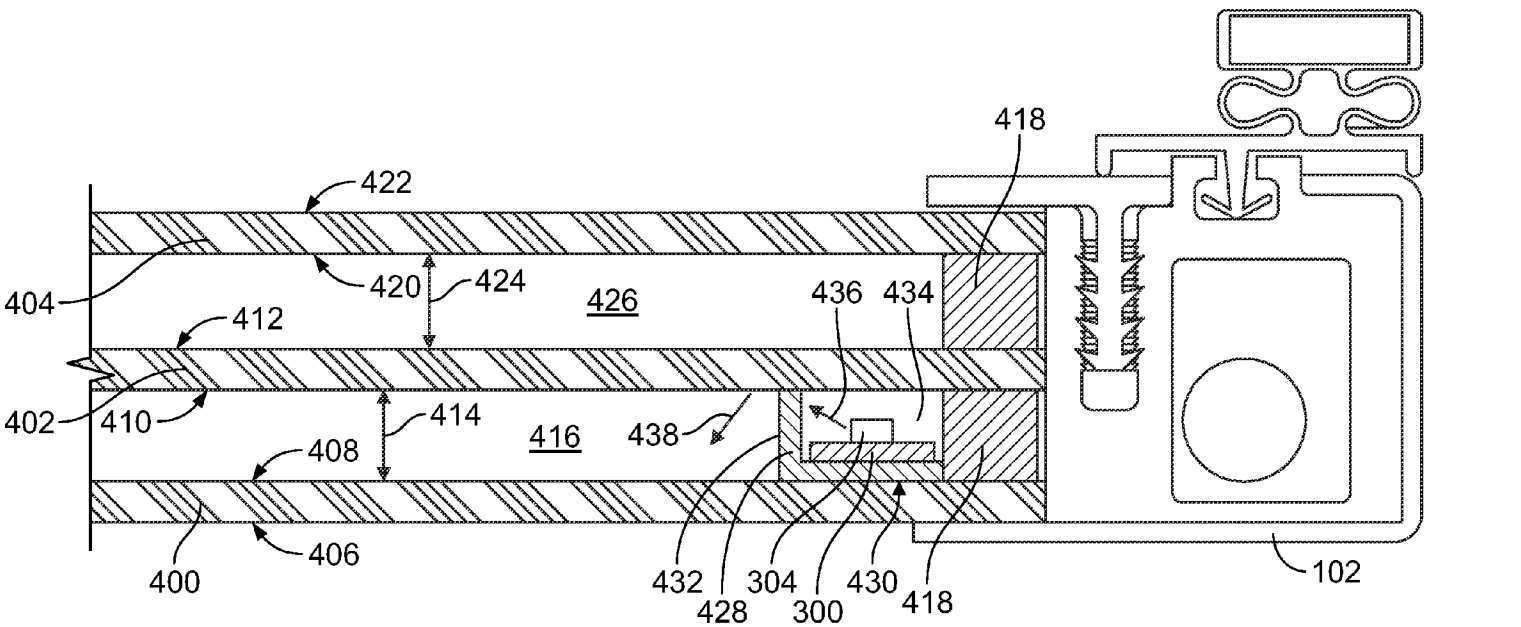
FIG. 4 is a partial cross-sectional view of the door assembly shown in FIG. 1 along line 4-4 in FIG. 1.

FIG. 4 is a cross-sectional view of the door assembly 100 along line 4-4 shown in FIG. 1. Several panes 400, 402, 404 of light transmissive material are disposed between opposite sides of the door frame 102. The panes 400, 402, 404 can be formed from planar sheets of material that allow light to pass through the panes 400, 402, 404 so that a person can see through the panes 400, 402, 404 and into the housing 202 of the cooling system 200. For example, the panes 400, 402, 404 can be formed from glass, acrylic, polycarbonate, thermoplastic, or the like. While three panes 400, 402, 404 are shown, alternatively, the door assembly 100 may include a lesser or larger number of panes. The pane 400 may be referred to as an outer pane or a first pane, the pane 402 may be referred to as an interior pane or second pane, and the pane 404 may be referred to as an inner pane or third pane.

The first pane 400 of the door assembly 100 can be referred to as the outer pane as the first pane 400 is outside of the cooling system 200 (shown in FIG. 2) and is closer to the viewer or customer outside of the cooling system 200 than the other panes 402, 404. The first pane 400 has an outwardly facing surface 406 and an opposite inwardly facing surface 408. The outwardly facing surface 406 may face the viewer or customer of the cooling system 200. The inwardly facing surface 408 can face the interior space 204 (shown in FIG. 2) of the cooling system 200 where the products being cooled are located. The inwardly facing surface 408 also can be referred to as an interior surface of the first pane 400.

The second pane 402 of the door assembly 100 has an outwardly facing surface 410 and an opposite inwardly facing surface 412. As shown in FIG. 4, the panes 400, 402 are parallel or approximately parallel to each other. The outwardly facing surface 410 of the second pane 402 faces a customer or viewer looking at the door assembly 100 from outside of the cooling system 200. The outwardly facing surface 410 of the second pane 402 also faces the inwardly facing surface 408 of the first pane 400.

The first pane 400 and the second pane 402 are spaced apart from each other by a separation gap 414 to define a first interior chamber 416 of the door assembly 100. The first interior chamber 416 also may be referred to as an outward interior chamber 416. One or more spacer bodies 418 are disposed between the first and second panes 400, 402 to define sides of the first interior chamber 416. The spacer bodies 418 may be sealed to the first and second panes 400, 402 so that the first interior chamber 416 is a sealed chamber that does not allow ingress or egress of moisture and/or air into or out of the first interior chamber 416. The spacer bodies 418 may extend around an entire outer perimeter of the first interior chamber 416 at or near the door frame 102. For example, one or more spacer bodies 418 may extend along and be coupled with the first and second panes 400, 402 along the vertical sides 108, 110 (shown in FIG. 1) and the horizontal sides 112, 114 (shown in FIG. 1) of the door assembly 100. The spacer bodies 418 can be formed from the same material as one or more of the panes 400, 402, 404, or from another material.

In the illustrated example, the third pane 404 of the door assembly 100 has an outwardly facing surface 420 and an opposite inwardly facing surface 422. The panes 400, 402, 404 can be parallel or approximately parallel to each other. The outwardly facing surface 420 of the third pane 404 faces a customer or viewer looking at the door assembly 100 from outside of the cooling system 200. The outwardly facing surface 420 of the third pane 404 also faces the inwardly facing surface 412 of the second pane 402. The inwardly facing surface 422 of the third frame 404 can face the products or goods inside the housing 202 (shown in FIG. 2) of the cooling system 200 (shown in FIG. 2).

The second pane 402 and the third pane 404 are spaced apart from each other by another separation gap 424 to define a second interior chamber 426 of the door assembly 100. The second interior chamber 426 also may be referred to as an inward interior chamber 426. One or more of the spacer bodies 418 also can be disposed between the second and third panes 402, 404 to define sides of the second interior chamber 426. The spacer bodies 418 may be sealed to the second and third panes 402, 404 so that the second interior chamber 426 is a sealed chamber that does not allow ingress or egress of moisture and/or air into or out of the second interior chamber 426. The spacer bodies 418 may extend around an entire outer perimeter of the second interior chamber 426 at or near the door frame 102, similar to as described above in connection with the spacer bodies 418 between the first and second panes 400, 402.

The interior chambers 416, 426 can provide for thermal insulation of the door assembly 100. For example, the spaces within the interior chambers 416, 426 can assist in reducing the amount of heat entering into the housing 202 of the cooling system 200 from outside of the housing 202 through the door assembly 100. While two interior chambers 416, 426 are shown in the illustrated example, alternatively, the door assembly 100 may include only a single interior chamber or more than two interior chambers 416, 426.

At least one of the light assemblies 300 is disposed within the first interior chamber 416 between the first pane 400 and the second pane 402. The door assembly 100 can include one light assembly 300 along the vertical side 110 (shown in FIG. 1) of the door assembly 100, a light assembly 300 along the other vertical side 108 (shown in FIG. 1) of the door assembly 100, a light assembly 300 along one horizontal side 112 (shown in FIG. 1) of the door assembly 100, and/or a light assembly 300 along the other horizontal side 114 (shown in FIG. 1) of the door assembly 100. Optionally, one or more other light assemblies 300 can be positioned elsewhere in the door assembly 100.

The light generating devices 304 of the light assembly 300 can be oriented to generate light toward the interior of the housing 202 of the cooling system 200. For example, if the light assembly 300 is disposed in the first interior chamber 416 between the first and second panes 400, 402, the light generating devices 304 can generate light that is directed generally toward the outwardly facing surface 410 of the second pane 402. The light assembly 300 can be mounted on a heat sink 428 (described below) so that the light generating devices 304 face the outwardly facing surface of the second pane 402. Orienting the light generating devices 304 in this direction can reduce the amount of light that is reflected back toward the viewer or customer. For example, the light generating devices 304 are mounted on a surface of the light assembly 300 that is parallel to the outwardly facing surfaces 410, 420 of the second and third panes 402, 404. If the light generating devices 304 were oriented at an oblique angle with respect to the outwardly facing surface 410 of the second pane 402, then more of the light may reflect off this outwardly facing surface 410 back toward a person attempting to see through the door assembly 100 into the housing 202 of the cooling system 200. As a result, the person may have difficulty in seeing the products inside the housing 202. Optionally, the light generating devices 304 may be oriented at an oblique angle with respect to the outwardly facing surface 410.

Positioning the light assemblies 300 in the first interior chamber 416 can assist in reducing the amount of thermal energy that is transferred from the light generating devices 304 to the interior space 204 of the housing 202 of the cooling system 200 shown in FIG. 2. For example, the second interior chamber 426 being disposed between the light assemblies 300 and the products in the housing 202 of the cooling system 200 can provide a thermal barrier (e.g., insulation) that reduces the amount of thermal energy transferred from the light generating devices 304 to the interior of the housing 202 of the cooling system 200. As a result, the cooling system 200 may expend less energy to keep the interior of the housing 202 (and the products located therein) at or below a designated temperature than if the second interior chamber 426 were not located between the light generating devices 304 and the interior of the housing 202 of the cooling system 200.

The heat sink 428 is disposed within the first interior chamber 416. The heat sink 428 is formed from a thermally conductive and/or electrically conductive material, such as a metal or metal alloy (e.g., aluminum, copper, steel, or the like). The heat sink 428 can be elongated along or near the vertical side 110 (shown in FIG. 1) of the door frame 102. For example, the heat sink 428 may be elongated in a direction that is parallel to the vertical side 110 of the door frame 102. If a light assembly 300 is disposed along the other vertical side 108 (shown in FIG. 1) and/or one or more of the horizontal sides 112, 114 (shown in FIG. 1) of the door frame 102, then heat sinks 428 also may be provided and elongated along the corresponding side 108, 112, and/or 114.

The cross-sectional view of the heat sink 428 shown in FIG. 4 shows an L-shape of the heat sink 428. The heat sink 428 can include a lateral elongated portion 430 connected with a transverse elongated portion 432. The heat sink 428 may be a single body formed from the portions 430, 432, or may be formed from the portions 430, 432 being separate bodies but connected with each other. The lateral elongated portion 430 is elongated in a direction that extends along and/or is parallel to the inwardly facing surface 408 of the first pane 400. The lateral elongated portion 430 can be coupled with the inwardly facing surface 408 of the first pane 400.

The transverse elongated portion 432 of the heat sink 428 can extend from the inwardly facing surface 408 of the first pane 400 toward the outwardly facing surface 410 of the second pane 402. In the illustrated example, the transverse elongated portion 432 of the heat sink 428 extends to and engages the outwardly facing surface 410 of the second pane 402. The transverse elongated portion 432 can contact the outwardly facing surface 410 of the second pane 402 such that the heat sink 428 defines a smaller interior portion 434 of the interior chamber 416. As shown in FIG. 4, the light assembly 300 can be located inside this smaller interior portion 434 of the interior chamber 416.

In operation, the heat sink 428 can transfer thermal energy from the light assembly 300 to the inwardly facing surface 408 of the first pane 400. The light assembly 300 is coupled to the heat sink 428 such that the lateral elongated portion 430 is disposed between the light assembly 300 and the inwardly facing surface 408 of the first pane 400. During operation of the light assembly 300, the light generating devices 304 generate thermal energy (e.g., heat). The lateral elongated portion 430 of the heat sink 428 conducts this thermal energy from the light assembly 300 to the inwardly facing surface 408 of the first pane 400. Because the heat sink 428 extends along and is coupled with the inwardly facing surface 408 of the first pane 400, more thermal energy from the light assembly 300 is conducted onto the inwardly facing surface 408 of the first pane 400 than to other locations of the door assembly 100.

Heating the inwardly facing surface 408 of the first pane 400 can reduce the amount of condensation that develops on the first pane 400 (e.g., on the outwardly facing surface 406 of the first pane 400) relative to a door assembly that does not include the heat sink 428. For example, without the heat sink 428, the heat generated by the light assembly 300 may heat the space inside one or more of the interior chambers 416, 426 without heating the inwardly facing surface 408 of the first pane 400 enough to prevent condensation. As a result, condensation may develop on the outwardly facing surface 406 of the first pane 400, and make it more difficult for customers or viewers to look through the door assembly 100 and see the products inside the cooling system 200. With the heat sink 428, the inwardly facing surface 408 of the first pane 400 is heated by more of the thermal energy generated by the light assembly 300 and, as a result, the first pane 400 is heated or warmed to prevent or reduce the amount of condensation that forms on the first pane 400.

The transverse elongated portion 432 of the heat sink 428 can assist in preventing or reducing reflection of light generated by the light assembly 300 back toward the customer of viewer of the cooling system 200. For example, the transverse elongated portion 432 of the heat sink 428 can block some of the light emanating from the light generating devices 304. Without the transverse elongated portion 432 of the heat sink 428, some of the light emanating from the light generating devices 304 could travel to and be reflected off of the outwardly facing surface 410 of the second pane 402. For example, without the transverse elongated portion 432, some of the light could travel along an incident path 436 toward the outwardly facing surface 410 and be reflected off of the outwardly facing surface 410 along a reflected path 438 back toward someone trying to look into the housing 202 through the panes 400, 402, 404.

This reflection of the light may interfere with customers or other viewers of the products inside the housing 202 of the cooling system 200 from clearly seeing the products. The transverse elongated portion 432 can reduce or prevent this light from reflecting back toward the customers or other viewers by preventing the light that is traveling along the incident path 436 from reaching and reflecting off the outwardly facing surface 410 of the second pane 402. The transverse elongated portion 432 can block and/or reflect this light. For example, the transverse elongated portion 432 may include a reflective surface of the heat sink 428 that reflects this light away from the portion of the outwardly facing surface 410 of the second pane 402 that is outside of the smaller interior portion 434 of the interior chamber 416. Optionally, the transverse elongated portion 432 may not include a reflective surface, but may be opaque such that the light cannot travel through the transverse elongated portion 432 of the heat sink 428 and reflected back toward a person trying to look through the panes 400, 402, 404.

Optionally, the transverse elongated portion 432 of the heat sink 428 also may thermally conduct some of the thermal energy from the light assembly 300 into the first interior chamber 416. At least some of the thermal energy generated by the light generating devices 304 can be thermally conducted by the transverse elongated portion 432 into the remainder of the first interior chamber 416 that is outside of the smaller interior portion 434 of the interior chamber 416. Conducting this thermal energy can assist in heating the first interior chamber 416 and/or the inwardly facing surface 408 of the first pane 400. As a result, condensation can be prevented from building up on the first pane 400 or the amount of condensation that forms on the first pane 400 can be reduced relative to other door assemblies that do not include the light assembly 300 and heat sink 428.

Figure 5:
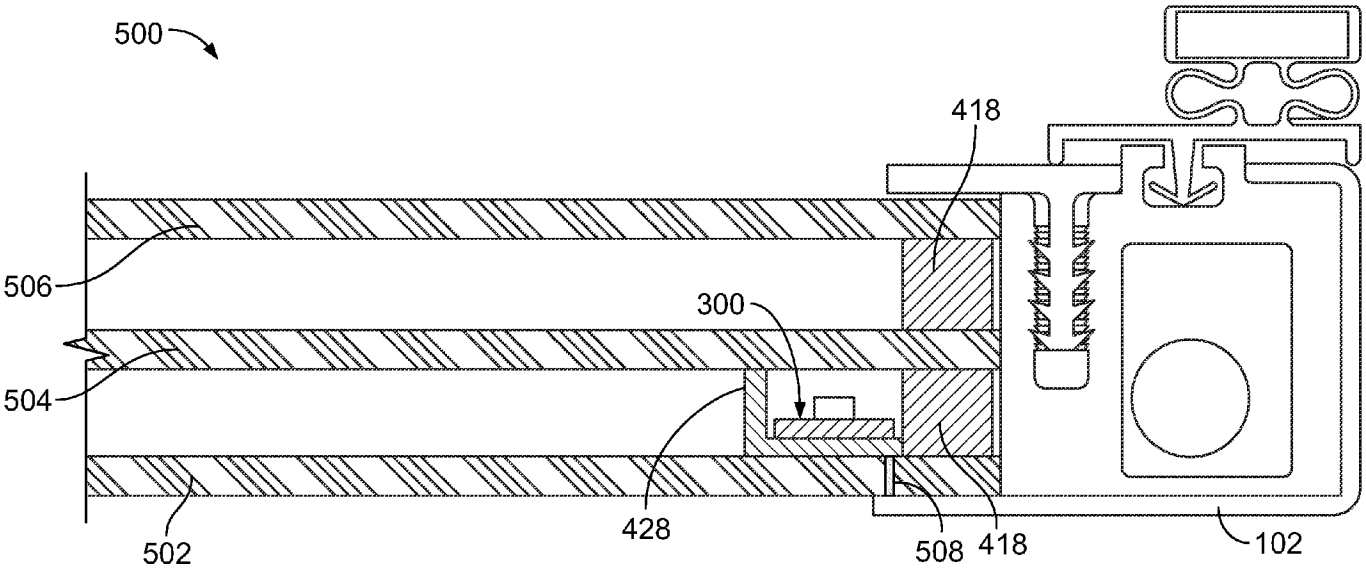
FIG. 5 illustrates a partial cross-sectional view of a door assembly according to another example of the inventive subject matter.

FIG. 5 illustrates a partial cross-sectional view of a door assembly 500 according to another example of the inventive subject matter. The door assembly 500 may be similar to the door assembly 100 shown in FIG. 1. For example, the door assembly 500 may include first, second, and third panes 502, 504, 506 that are similar or identical to the corresponding panes 400, 402, 404 shown in FIG. 4, the door frame 102, spacer bodies 418, the heat sink 428, and one or more of the light assemblies 300.

One difference between the door assembly 500 shown in FIG. 5 and the door assembly 100 shown in FIG. 1 is the inclusion of one or more conductive bodies 508 that extend through openings in the first pane 502. The conductive bodies 508 and conductively couple the heat sink 428 with the door frame 102. The conductive bodies 508 may be in the shape of wires, bars, columns, or other shapes, and may extend through openings in the first pane 502. The conductive bodies 508 may seal these openings in the first pane 502 so that moisture cannot enter into the interior chamber between the first and second panes 502, 504 of the door assembly 500.

The conductive bodies 508 can thermally conduct at least some of the heat that is generated by the light assembly 300 from the heat sink 428 (e.g., via the lateral elongated portion 430 of the heat sink 428) and to the door frame 102. This heat can assist in warming or heating the door frame 102 so that the door frame 102 and/or the handle 104 (shown in FIG. 1) of the door frame 102 is not cold or cool to the touch. Optionally, this heat can assist in heating the door frame 102 and/or handle 104 to prevent formation of condensation on the door frame 102 and/or handle 104. For example, when the door assembly 500 is opened, the door frame 102 and/or handle 104 may be cooled when partially exposed to the cooler environment inside the housing 202 (shown in FIG. 2) of the cooling system 200 (shown in FIG. 2). If the door frame 102 is not heated, then condensation may form on the door frame 102 and/or handle 104, which can be undesirable for persons seeking to open the door assembly 500. Heating the door frame 102 with at least some of the heat from the light assembly 300 can reduce or prevent this formation of condensation.

Figure 6:
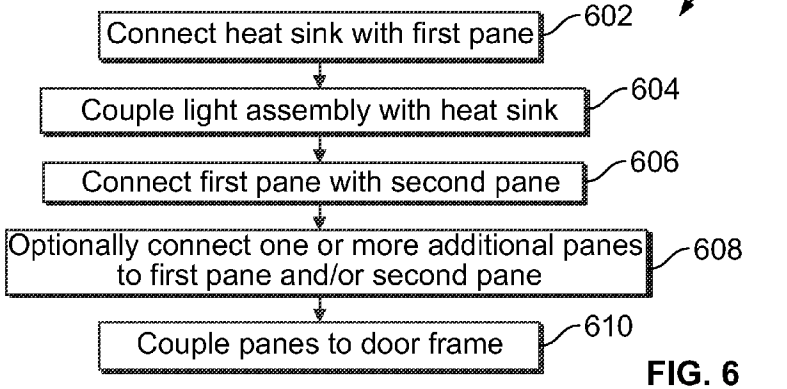
FIG. 6 is a flowchart of a method for providing a thermally insulated door assembly and/or for heating the thermally insulated door assembly in accordance with one example of the inventive subject matter described herein.

FIG. 6 is a flowchart of a method 600 for providing a thermally insulated door assembly and/or for heating the thermally insulated door assembly in accordance with one example of the inventive subject matter described herein. The method 600 may be used to create the door assembly 100 and/or 500 shown and described above.

At 602, one or more heat sinks are connected with a first pane of light transmissive material. The heat sinks can have lateral and transverse elongated portions, such as in the shape of the letter L. The lateral elongated portion can be coupled to one surface of the pane, such as a surface that will be an inwardly facing surface of the first pane.

At 604, one or more light assemblies are coupled with the heat sinks. For example, the light assemblies can be affixed to the lateral elongated portions of the heat sinks such that the lateral elongated portions of the heat sinks are disposed between the light assemblies and the first pane of light transmissive material.

At 606, the first pane of light transmissive material is connected with a second pane of light transmissive material. For example, the first and second panes of light transmissive material may be connected with each other by spacer bodies. The connecting of these panes with each other by the spacer bodies can form an interior chamber that is bounded by the panes and the spacer bodies. As described above, the first pane having the heat sinks and light assemblies connected thereto can be connected with the second pane such that the heat sinks and light assemblies are disposed within the interior chamber formed between the panes. The transverse elongated portions of the heat sinks can further define smaller interior portions of the interior chamber, as described above. The light assemblies can be disposed within these smaller interior portions, as shown in FIG. 4.

At 608, one or more additional spacer bodies and/or panes of light transmissive material may be connected to the first or second panes. For example, a third pane may be connected to the second pane by one or more additional spacer bodies to form another interior chamber between the second and third panes. In one embodiment, additional light assemblies and/or heat sinks can be disposed between the second and third panes, similar to as described above in connection with the heat sinks and light assemblies disposed between the first and second panes.

At 610, the panes are coupled with a door frame. The door frame may extend around outer perimeters of the panes, similar to as shown in FIG. 1. The door assembly that is thereby formed can be coupled with a cooling system, as described above.

In one example of the inventive subject matter described herein, a thermally insulated door assembly includes an outer first pane of light transmissive material, a second pane of light transmissive material, a light assembly, and a heat sink. The first pane has an outwardly facing surface and an opposite inwardly facing surface. The second pane has an outwardly facing surface and an opposite inwardly facing surface. The outwardly facing surface of the second pane faces the inwardly facing surface of the first pane. The first pane and the second pane are spaced apart from each other by a separation gap to define an interior chamber. The light assembly is disposed within the interior chamber between the first pane and the second pane, and is configured to generate light within the interior chamber. The heat sink is disposed within the interior chamber and coupled with the light assembly and the inwardly facing surface of the first pane. The heat sink is configured to conduct thermal energy generated by the light assembly onto the inwardly facing surface of the first pane and into the interior chamber such that the inwardly facing surface of the first pane and the interior chamber are heated by the light assembly.

In one aspect, the first pane and the second pane provide viewing of product stored in a refrigerated housing to which the door assembly is coupled and that provides access to the product in the refrigerated housing. The inwardly facing surface of the first pane and the interior chamber between the first pane and the second pane can be heated by the light assembly to prevent condensation on the first pane.

In one aspect, the heat sink includes one or more reflective surfaces that reflect the light generated by the light assembly away from at least one of the interior chamber between the first and second panes or the outwardly facing surface of the second pane.

In one aspect, the light assembly comprises one or more light emitting diodes (LEDs) that generate the thermal energy and the light.

In one aspect, at least one of the first pane and the second pane is a glass pane.

In one aspect, at least one of the first pane and the second pane is a polymer screen.

In one aspect, the door assembly also includes a third pane of light transmissive material having an inwardly surface and an opposite outwardly facing surface. The outwardly facing surface of the third pane faces and is spaced apart from the inwardly facing surface of the second pane such that another interior chamber is defined between the second pane and the third pane.

In one aspect, the first pane and the second pane each extends between opposite upper and lower edges along a first direction and between opposite side edges along a second direction that is transverse to the first direction. The door assembly also includes a door frame extending along and coupled with the upper and lower edges and the side edges of the first and second pane.

In one aspect, the door assembly also includes one or more conductive bodies extending through the first pane and coupled with both the heat sink and the door frame. The one or more conductive bodies can be configured to transfer at least a portion of the thermal energy generated by the light assembly to the door frame in order to heat the door frame.

In another example of the inventive subject matter described herein, a method for providing a thermally insulated door assembly and/or for heating a thermally insulated door assembly is provided. The method includes positioning a heat sink in an interior chamber of the door assembly between an outer first pane of light transmissive material and a second pane of light transmissive material. The first pane has an outwardly facing surface and an opposite inwardly facing surface. The second pane has an outwardly facing surface and an opposite inwardly facing surface. The outwardly facing surface of the second pane faces the inwardly facing surface of the first pane. The first pane and the second pane are spaced apart from each other by a separation gap to define the interior chamber in which the heat sink is positioned. The method also can include coupling a light assembly with the heat sink in the interior chamber of the door assembly. The light assembly can be coupled with the heat sink to generate light in the interior chamber of the door assembly and to generate thermal energy. The heat sink can be positioned in the interior chamber such that the heat sink is coupled with the inwardly facing surface of the first pane such that the heat sink conducts the thermal energy generated by the light assembly onto the inwardly facing surface of the first pane and into the interior chamber in order to heat the inwardly facing surface of the first pane and the interior chamber.

In one aspect, the first pane and the second pane provide viewing of product stored in a refrigerated housing to which the door assembly is coupled and that provides access to the product in the refrigerated housing. The heat sink can be positioned in the interior chamber so that the inwardly facing surface of the first pane and the interior chamber between the first pane and the second pane are heated by the light assembly to prevent condensation on the first pane.

In one aspect, the heat sink includes one or more reflective surfaces and the heat sink is positioned such that the one or more reflective surfaces reflect the light generated by the light assembly away from at least one of the interior chamber between the first and second panes or the outwardly facing surface of the second pane.

In one aspect, the first pane and the second pane each extends between opposite upper and lower edges along a first direction and between opposite side edges along a second direction that is transverse to the first direction. The method can also include coupling a door frame with the upper and lower edges and the side edges of the first and second pane.

In one aspect, the method also can include coupling one or more conductive bodies with the heat sink and the door frame such that the one or more conductive bodies extend through the first pane in order to transfer at least a portion of the thermal energy generated by the light assembly to the door frame and heat the door frame.

In another example of the inventive subject matter described herein, a door assembly includes an outer glass pane, an interior glass pane, an inner glass pane, a light assembly, and a heat sink. The outer glass pane has an exterior surface and an opposite interior surface. The interior glass pane has an outwardly facing surface and an opposite inwardly facing surface. The interior glass pane is spaced apart from the outer glass pane by a separation gap to define a first interior chamber. The outwardly facing surface of the interior glass pane faces the interior surface of the outer glass pane. The inner glass pane has an outwardly facing surface and an opposite interior surface. The inner glass pane is spaced apart from the interior glass pane by a separation gap to define a second interior chamber. The outwardly facing surface of the inner glass pane faces the inwardly facing surface of the interior glass pane. The light assembly is disposed in the first interior chamber between the outer glass pane and the interior glass pane. The light assembly is configured to generate light and thermal energy. The heat sink is disposed in the first interior chamber between the outer glass pane and the interior glass pane. The heat sink prevents condensation on the outer glass pane by conducting at least some of the thermal energy generated by the light assembly to the interior surface of the outer glass pane to heat the interior surface of the outer glass pane.

In one aspect, the heat sink is coupled with the interior surface of the outer glass pane.

In one aspect, the heat sink extends from the interior surface of the outer glass pane to the inwardly facing surface of the interior glass pane.

In one aspect, the heat sink includes one or more reflective surfaces that reflect the light generated by the light assembly away from at least one of the outwardly facing surface of the interior glass pane or the first interior chamber.

In one aspect, the heat sink includes a lateral elongated portion and a transverse elongated portion coupled with each other and extending along different directions. The lateral elongated portion can be coupled with and extend along the interior surface of the outer glass pane. The transverse elongated portion can extend from the interior surface of the outer glass pane to the outwardly facing surface of the interior glass pane.

In one aspect, the lateral elongated portion of the heat sink thermally conducts the thermal energy generated by the light assembly to the interior surface of the outer glass pane to heat the interior surface of the outer glass pane.

In one aspect, the transverse elongated portion of the heat sink reflects the light generated by the light assembly away from the first interior chamber.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended clauses, along with the full scope of equivalents to which such clauses are entitled. In the appended clauses, the terms "including" and "in which" are used as the plain-English equivalents of the respective terms "comprising" and "wherein." Moreover, in the following clauses, the terms "first," "second," and "third," etc. are used merely as labels, and are not intended to impose numerical requirements on their objects. Further, the limitations of the following clauses are not written in means-plus-function format and are not intended to be interpreted based on 35 U.S.C. §112(f), unless and until such clause limitations expressly use the phrase "means for" followed by a statement of function void of further structure. For example, the recitation of a "mechanism for," "module for," "device for," "unit for," "component for," "element for," "member for," "apparatus for," "machine for," or "system for" is not to be interpreted as invoking 35 U.S.C. §112(f) and any claim that recites one or more of these terms is not to be interpreted as a means-plus-function claim.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the clauses, and may include other examples that occur to one of ordinary skill in the art. Such other examples are intended to be within the scope of the clauses if they have structural elements that do not differ from the literal language of the clauses, or if they include equivalent structural elements with insubstantial differences from the literal languages of the clauses.

As used herein, an element or step recited in the singular and proceeded with the word "a" or "an" should be understood as not excluding plural of said elements or steps, unless such exclusion is explicitly stated. Furthermore, references to "one embodiment" or "an embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A thermally insulated door assembly comprising:

an outer first pane of light transmissive material having an outwardly facing surface and an opposite inwardly facing surface;

a second pane of light transmissive material having an outwardly facing surface and an opposite inwardly facing surface, the outwardly facing surface of the second pane facing the inwardly facing surface of the first pane, the first pane and the second pane spaced apart from each other by a separation gap to define an interior chamber;

a third pane of light transmissive material having an inwardly surface and an opposite outwardly facing surface, the outwardly facing surface of the third pane facing and spaced apart from the inwardly facing surface of the second pane such that another interior chamber is defined between the second pane and the third pane;

a light assembly disposed within the interior chamber between the first pane and the second pane, the light assembly configured to generate light within the interior chamber; and a heat sink disposed within the interior chamber and coupled with the light assembly and the inwardly facing surface of the first pane, wherein the heat sink is configured to conduct thermal energy generated by the light assembly onto the inwardly facing surface of the first pane and into the interior chamber such that the inwardly facing surface of the first pane and the interior chamber are heated by the light assembly.

2. The door assembly of claim 1, wherein the first pane and the second pane provide viewing of product stored in a refrigerated housing to which the door assembly is coupled and that provides access to the product in the refrigerated housing, and wherein the inwardly facing surface of the first pane and the interior chamber between the first pane and the second pane are heated by the light assembly to prevent condensation on the first pane.

3. The door assembly of claim 1, wherein the heat sink includes one or more reflective surfaces that reflect the light generated by the light assembly away from at least one of the interior chamber between the first and second panes or the outwardly facing surface of the second pane.

4. The door assembly of claim 1, wherein the light assembly comprises one or more light emitting diodes (LEDs) that generate the thermal energy and the light.

5. The door assembly of claim 1, wherein at least one of the first pane and the second pane is a glass pane.

6. The door assembly of claim 1, wherein the first pane and the second pane each extends between opposite upper and lower edges along a first direction and between opposite side edges along a second direction that is transverse to the first direction, and further comprising a door frame extending along and coupled with the upper and lower edges and the side edges of the first and second pane.

7. The door assembly of claim 6, further comprising one or more conductive bodies extending through the first pane and coupled with both the heat sink and the door frame, wherein the one or more conductive bodies are configured to transfer at least a portion of the thermal energy generated by the light assembly to the door frame in order to heat the door frame.

8. A method for heating a thermally insulated door assembly, the method comprising:

positioning a heat sink in an interior chamber of the door assembly between an outer first pane of light transmissive material and a second pane of light transmissive material, the first pane having an outwardly facing surface and an opposite inwardly facing surface, the second pane having an outwardly facing surface and an opposite inwardly facing surface, the outwardly facing surface of the second pane facing the inwardly facing surface of the first pane, the first pane and the second pane spaced apart from each other by a separation gap to define the interior chamber in which the heat sink is positioned, the door assembly also including a third-pane of light transmissive material having an inwardly surface and an opposite outwardly facing surface, the outwardly facing surface of the third pane facing and spaced apart from the inwardly facing surface of the second pane such that another interior chamber is defined between the second pane and the third pane; and coupling a light assembly with the heat sink in the interior chamber of the door assembly, the light assembly coupled with the heat sink to generate light in the interior chamber of the door assembly and to generate thermal energy, wherein the heat sink is positioned in the interior chamber such that the heat sink is coupled with the inwardly facing surface of the first pane such that the heat sink conducts the thermal energy generated by the light assembly onto the inwardly facing surface of the first pane and into the interior chamber in order to heat the inwardly facing surface of the first pane and the interior chamber.

9. The method of claim 8, wherein the first pane and the second pane provide viewing of product stored in a refrigerated housing to which the door assembly is coupled and that provides access to the product in the refrigerated housing, and wherein the heat sink is positioned in the interior chamber so that the inwardly facing surface of the first pane and the interior chamber between the first pane and the second pane are heated by the light assembly to prevent condensation on the first pane.

10. The method of claim 8, wherein the heat sink includes one or more reflective surfaces and the heat sink is positioned such that the one or more reflective surfaces reflect the light generated by the light assembly away from at least one of the interior chamber between the first and second panes or the outwardly facing surface of the second pane.

11. The method of claim 8, wherein the first pane and the second pane each extends between opposite upper and lower edges along a first direction and between opposite side edges along a second direction that is transverse to the first direction, and further comprising coupling a door frame with the upper and lower edges and the side edges of the first and second pane.

12. The method of claim 11, further comprising coupling one or more conductive bodies with the heat sink and the door frame such that the one or more conductive bodies extend through the first pane in order to transfer at least a portion of the thermal energy generated by the light assembly to the door frame and heat the door frame.

13. A door assembly comprising:

an outer glass pane having an exterior surface and an opposite interior surface;

an interior glass pane having an outwardly facing surface and an opposite inwardly facing surface, the interior glass pane spaced apart from the outer glass pane by a separation gap to define a first interior chamber, the outwardly facing surface of the interior glass pane facing the interior surface of the outer glass pane;

an inner glass pane having an outwardly facing surface and an opposite interior surface, the inner glass pane spaced apart from the interior glass pane by a separation gap to define a second interior chamber, the outwardly facing surface of the inner glass pane facing the inwardly facing surface of the interior glass pane;

a light assembly disposed in the first interior chamber between the outer glass pane and the interior glass pane, the light assembly configured to generate light and thermal energy; and a heat sink disposed in the first interior chamber between the outer glass pane and the interior glass pane, wherein the heat sink prevents condensation on the outer glass pane by conducting at least some of the thermal energy generated by the light assembly to the interior surface of the outer glass pane to heat the interior surface of the outer glass pane.

14. The door assembly of claim 13, wherein the heat sink is coupled with the interior surface of the outer glass pane.

15. The door assembly of claim 13, wherein the heat sink extends from the interior surface of the outer glass pane to the inwardly facing surface of the interior glass pane.

16. The door assembly of claim 13, wherein the heat sink includes one or more reflective surfaces that reflect the light generated by the light assembly away from at least one of the outwardly facing surface of the interior glass pane or the first interior chamber.

17. The door assembly of claim 13, wherein the heat sink includes a lateral elongated portion and a transverse elongated portion coupled with each other and extending along different directions, the lateral elongated portion coupled with and extending along the interior surface of the outer glass pane, the transverse elongated portion extending from the interior surface of the outer glass pane to the outwardly facing surface of the interior glass pane.

18. The door assembly of claim 17, wherein the lateral elongated portion of the heat sink thermally conducts the thermal energy generated by the light assembly to the interior surface of the outer glass pane to heat the interior surface of the outer glass pane.

19. The door assembly of claim 17, wherein the transverse elongated portion of the heat sink reflects the light generated by the light assembly away from the first interior chamber.

* * * * *